US007543701B2

(12) United States Patent
Suda

(10) Patent No.: US 7,543,701 B2
(45) Date of Patent: Jun. 9, 2009

(54) STORAGE IMPLEMENT AND BAG WITH MOVABLE STORAGE IMPLEMENT

(76) Inventor: Keiko Suda, #306, 4-10-30 Takaido-higashi, Suginami-ku, Tokyo (JP) 168-0072

( * ) Notice: Subject to any disclaimer, the term of this patent is extended or adjusted under 35 U.S.C. 154(b) by 4 days.

(21) Appl. No.: 11/182,047

(22) Filed: Jul. 15, 2005

(65) Prior Publication Data

US 2006/0102506 A1 May 18, 2006

(30) Foreign Application Priority Data

Nov. 16, 2004 (JP) ..... 2004-360549

(51) Int. Cl.
*B65D 69/00* (2006.01)

(52) U.S. Cl. ..... 206/231; 206/38; 206/39; 206/481

(58) Field of Classification Search ..... 206/37, 206/37.1, 38, 38.1, 39, 231, 477–483, 495, 206/549, 577; 211/10, 85.15, 87.01, 86.01, 211/103, 113; 383/6, 7, 38–40; 248/200, 248/207; 190/109, 110, 115
See application file for complete search history.

(56) References Cited

U.S. PATENT DOCUMENTS

| | | | | |
|---|---|---|---|---|
| 4,463,789 | A * | 8/1984 | Leiserson | 383/38 |
| 5,779,033 | A * | 7/1998 | Roegner | 383/40 |
| 5,803,605 | A * | 9/1998 | Masi | 383/38 |
| 5,943,765 | A * | 8/1999 | Shikakubo et al. | 29/705 |
| 6,209,734 | B1 * | 4/2001 | Wang | 211/87.01 |
| 6,273,872 | B1 * | 8/2001 | Friedman | 224/665 |
| 6,994,050 | B2 * | 2/2006 | Johnson et al. | 224/406 |
| 2006/0011686 | A1 * | 1/2006 | Latham | 383/38 |

FOREIGN PATENT DOCUMENTS

JP 02000236929 A * 9/2000

* cited by examiner

*Primary Examiner*—Luan K Bui

(57) ABSTRACT

The storage implement has a base plate and vertical and horizontal belts and is moved vertically so that it can be stored in any bag, and the user can pull the storage part up at hand.

5 Claims, 17 Drawing Sheets

STORAGE IMPLEMENT AND BAG WITH MOVABLE STORAGE IMPLEMENT

FIELD OF THE INVENTION

The present invention relates generally to a storage implement which can install the storage part in storage space in bags and storage boxes and can take stored objects in and out easily without putting hands therein and feeling for it in the bags since the user lifts the storage part when it takes out the stored objects.

BACKGROUND OF THE INVENTION

The storage in the conventional bag is used for the pockets attached at the inner side or formed at the inner partition, or classified storage implement formed in the shape of a case or porch.

Moreover, there is the storage implement as disclosed in the reference document 1 (Japanese Patent Laid-Open Publication No. 2000-236929) which is attached the storage member to the base body which can be stored in the bag at the state of position fixation freely as a partition used in the bags.

Therefore, there are the following problems in the conventional bag.

Since the stored objects which are stored in the confined storage part are stored in the state which they are piled up in the bag, it is difficult to take out a required stored objects. Moreover, there is a possibility that the shape of the bag changes by collecting and spreading the stored objects at the bottom of the bag.

There are the following problems in the reference document 1.

Although many storage parts are installed in the bag and the storage parts are attached at the free position, since the storage parts are fixed when in use, the user puts the hands in the bag and takes out the stored objects, and it is difficult to take out the target stored objects certainly and easily.

Moreover, even though the storage part is attached with the both-sided fastener and the like detachably, the work removed in a transverse direction is required within the bag, and it is difficult to work according to the size and shape of the bag.

Then, since the check of the stored objects cannot be performed in the state which they put into the bag, there is a high possibility for removing other storage part. In order to improve this situation, there is the necessity of lifting and checking the partition base one by one in the state where all storage parts are installed in the bag.

SUMMARY OF THE INVENTION

Accordingly, it is an object of the present invention to provide a storage implement which can store in any bag and can be lifted a storage part at hand.

The present invention is understood to encompass embodiments which include all or only a portion of the above objects, features and advantages which, unless recited in claims defining the invention, are understood not to limit interpretation of such claims. The above, and other objects, features and advantages of the present invention will become apparent from the following description read in conjunction with the accompanying drawings, in which like reference numerals designate the same elements.

It is to be expressly understood, however, that the drawings are for the purpose of illustration and description only, and are not intended as a definition of the limits of the invention.

DETAILED DESCRIPTION OF THE PREFERRED EMBODIMENTS

Preferred embodiments of the present invention are described in more detail below referring to the accompanying drawings.

An understanding of the present invention may be best gained by reference FIGS. 1 to 10.

Figure 1:
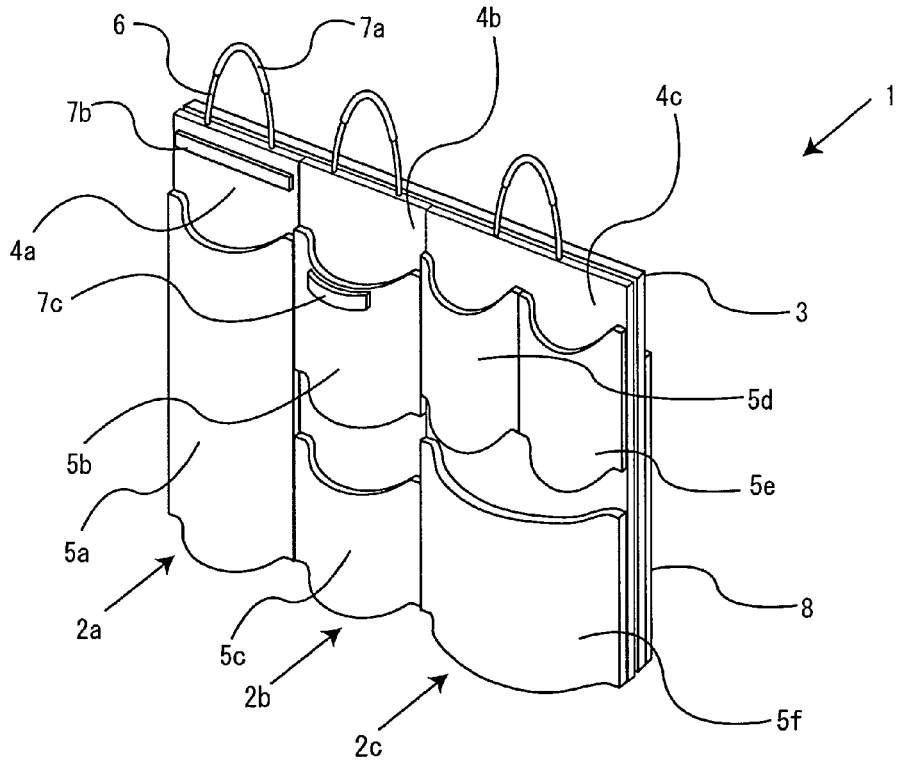
FIG. 1 is a perspective view of the present invention.
Figure 2:
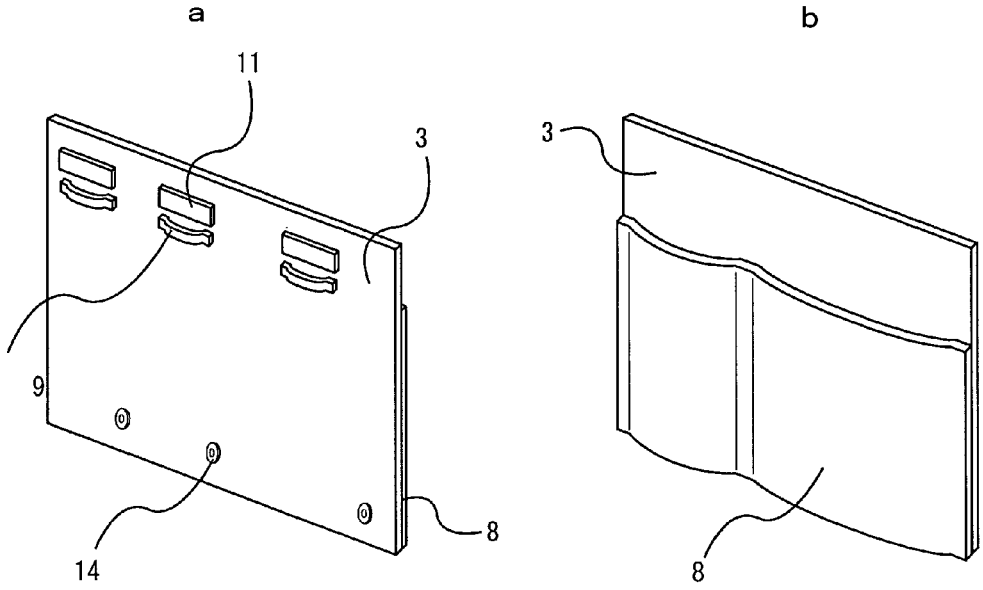
FIG. 2 is an explanation view of a base of the present invention.
Figure 3:
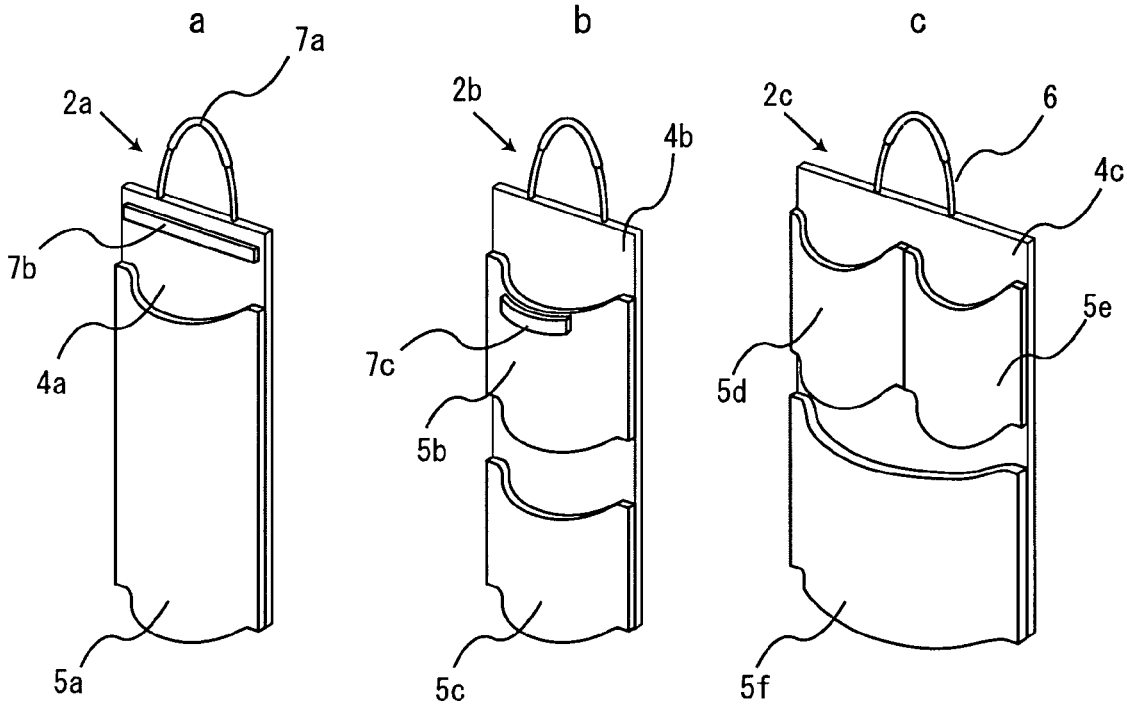
FIG. 3 is an explanation view of a movable storage member of the present invention.
Figure 4:
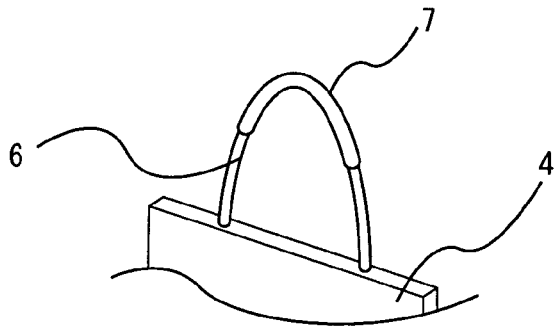
FIG. 4 is an explanation view of a handle of the present invention.
Figure 5:
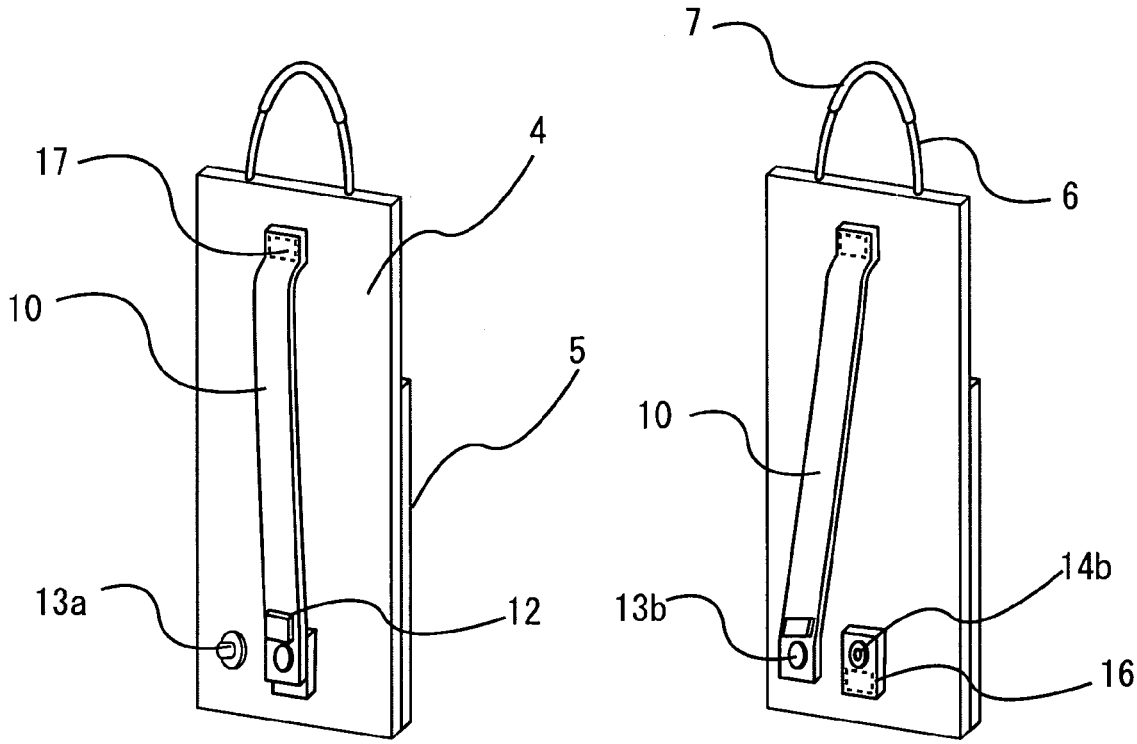
FIG. 5 is an explanation view of a movable storage member of the present invention.
Figure 6:
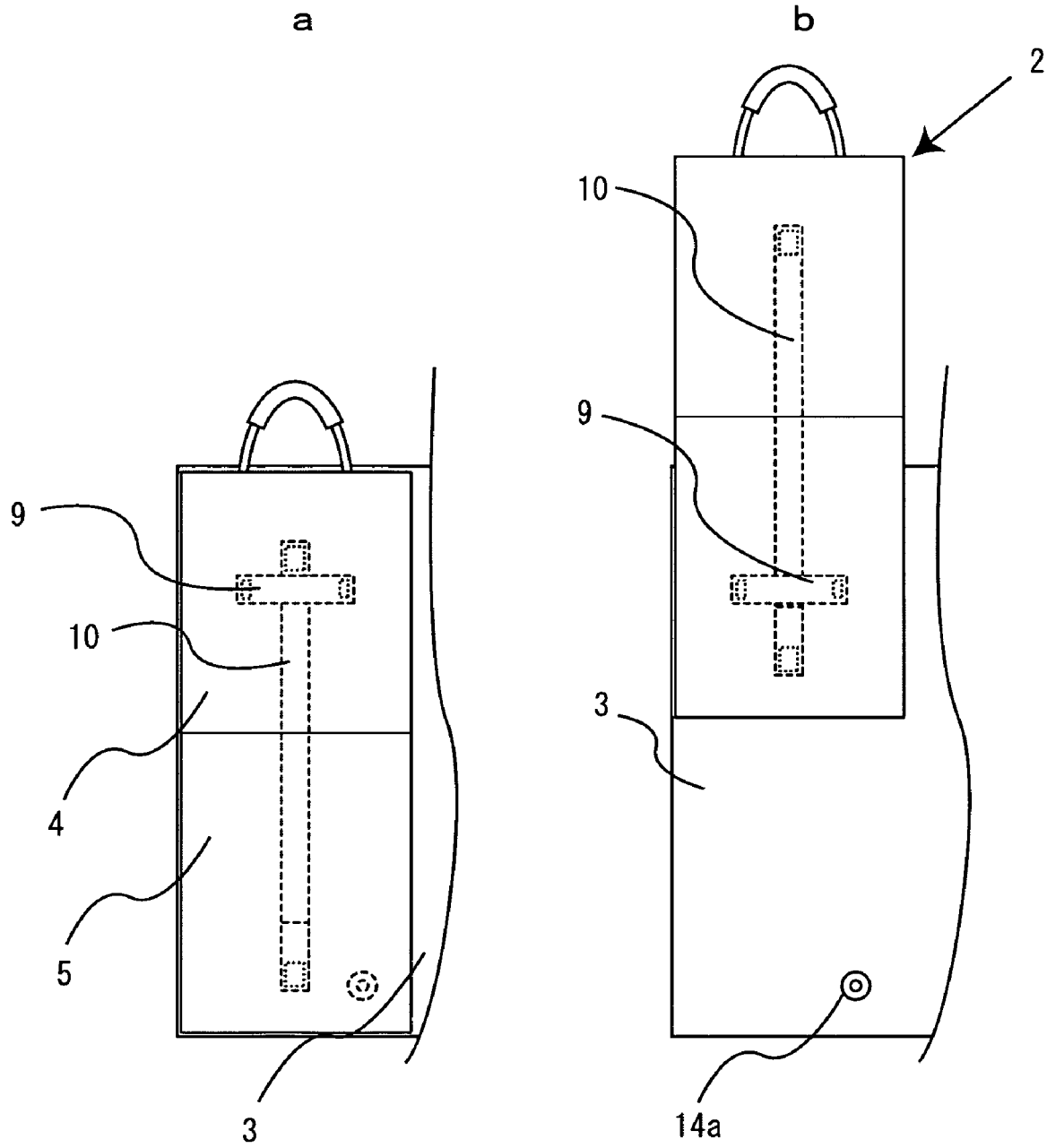
FIG. 6 is an explanation view of a movable storage member when in use of the present invention.
Figure 7:
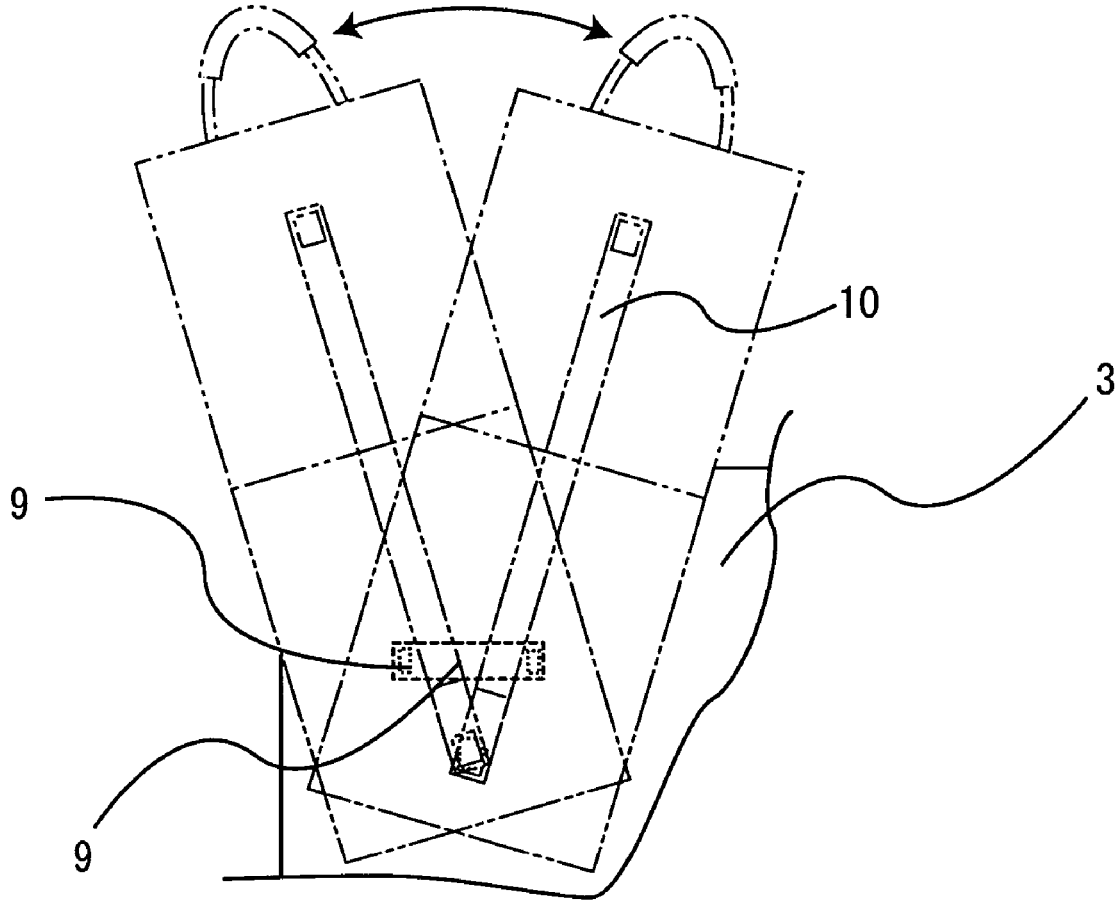
FIG. 7 is an explanation view of a movable storage member when in use of the present invention.
Figure 8:
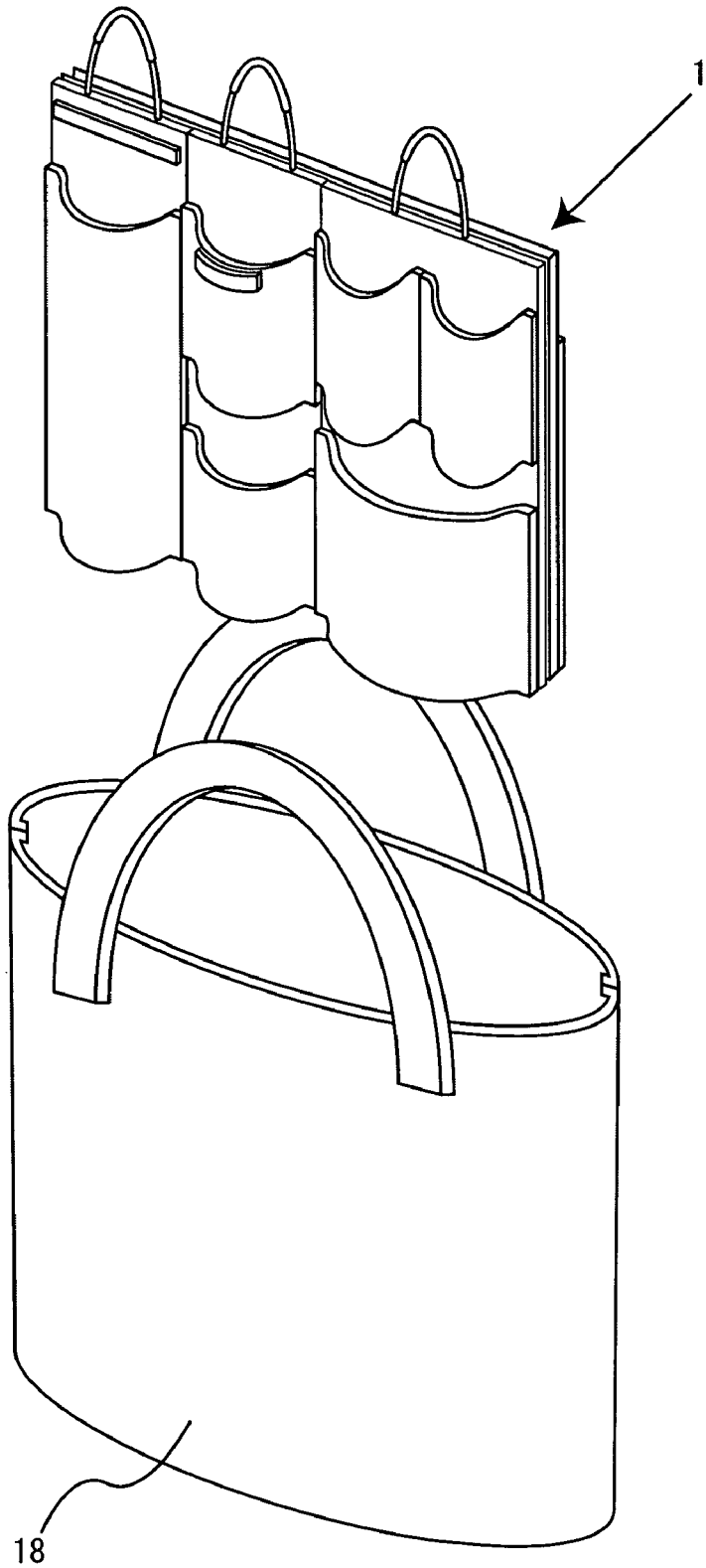
FIG. 8 is an explanation view when in use of the present invention.
Figure 9:
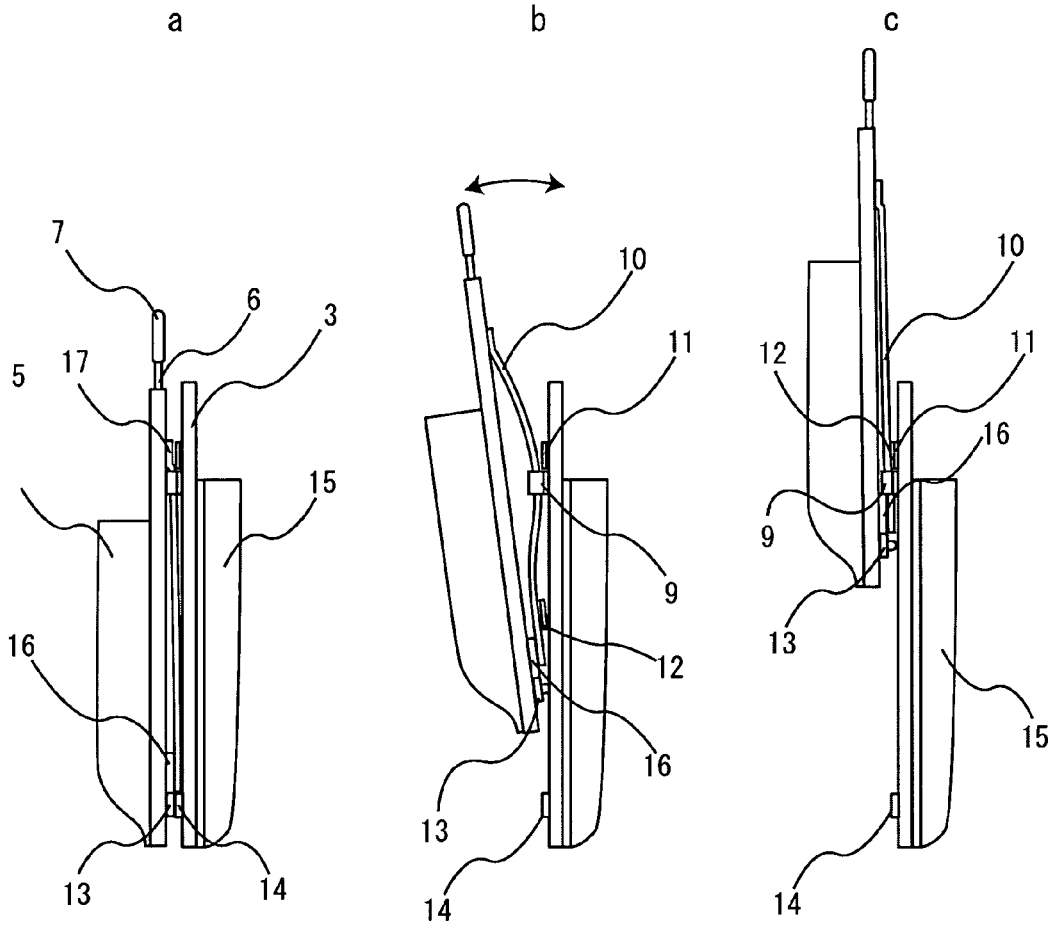
FIG. 9 is an explanation view of a movable storage member when in use of the present invention.
Figure 10:
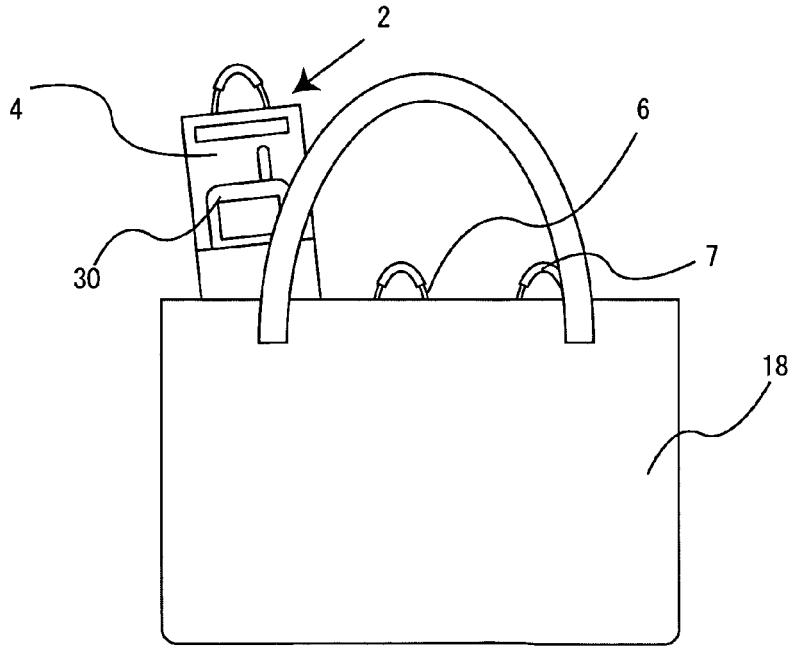
FIG. 10 is an explanation view when in use of the present invention.

FIG. 1 is a perspective view of the present invention; FIG. 2 is an explanation view of a base of the present invention; FIG. 3 is an explanation view of a movable storage member of the present invention; FIG. 4 is an explanation view of a handle of the present invention; FIG. 5 is an explanation view of a movable storage member of the present invention; FIG. 6 is an explanation view of a movable storage member when in use of the present invention; FIG. 7 is an explanation view of a movable storage member when in use of the present invention; FIG. 8 is an explanation view when in use of the present invention; FIG. 9 is an explanation view of a movable storage member when in use of the present invention; and FIG. 10 is an explanation view when in use of the present invention A storage implement of the present invention is comprised of a base body 3; a movable storage member 2; and means for connecting, such as a belt, capable of attaching the base body 3 and movable storage member 2. With reference to the figures, it is explained that three movable storage member 2 are provided at a front surface of the base body.

The base body 3 is explained with reference to FIG. 2. FIG. 2*a* illustrates a perspective view of the front surface thereof, and FIG. 2*b* illustrates a perspective view of a back surface of thereof.

Three base belts 9 are attached at an upper part of the front surface of the base body 3. Each base belt 9 is provided at the position adjacent a center portion of the movable storage member which is arranged at the front surface thereof, and the right and left parts of the base belt 9 are fixed by sawing, adhesive and the like.

One side 11 of a both-sided adhesive is attached at an upper part of the base belt 9.

In addition, three snaps 14 are attached at a lower part of the front surface thereof. The snaps 14 are positioned which are not lined up horizontally from the base belt 9 that is provided at the upper part of the base body 3.

A base storage part 8 is attached to a backside of the base body 3. The base storage part 8 is sawed, adhered the circumferential part and center part thereof at the backside of the base body 3 so as to be a pocket of the upper edge and to be formed any storage part.

The movable storage member is explained below.

FIG. 3 illustrates a movable storage member 2*a*, which is longer than is wide, having one storage part 5*a*; a movable storage member 2*b*, which is longer than is wide, having a storage part 5*b* and a base storage part 5*c* at the upper and lower parts thereof; and a movable storage member 2*c* having a storage part 5*d* and a storage part 5*e* attached at the right and left sides of the upper part thereof and a storage part 5*f* attached at the lower part thereof.

Each movable storage member 2 has each storage part 5 attached at the front surface of the movable base 4, and each handle 6 is attached to the upper part of each movable storage member 2.

A persistence phosphor 7 including high-persistence phosphor, high-intensity light source and the like is used as means for visibility at night, in the dark and the like. For the movable storage member 2*a*, a persistence phosphor 7*b* is attached horizontally at the exposed portion of the upper part of the storage part 5*a* of the movable base 4*a*. For the movable storage member 2*b*, a persistence phosphor 7*c* is attached at the surface of the upper part of the storage part 5*b*.

In addition, as shown in FIG. 4, the persistence phosphor 7 is provided at the upper part of the handle 6 so as to cover the handle 6.

The back surface of the movable storage member 2 is explained with reference to FIG. 5. The movable belt 10 is attached at the back surface of the movable base 4 to a vertical direction. The movable belt 10 is defined by a fixation part 17, fixing by sutura or adhesion the upper end portion thereof, providing the snap 13*b* at the lower part thereof to a direction of the movable base. In addition, another side of the both-sided adhesive 12 is formed at the upper portion of the snap 13*b* of the movable belt 10.

A fixation member 16 is attached at the lower part of the back surface of the movable base 4, fixing detachably the end part of the movable belt 10. A snap 13*a* is provided to the fixation member 16, detaching to a snap 13*b*.

A snap 13*a* is attached at the lower part of the movable base 4 corresponding to the position which jolts out of alignment to the fixation member 16 to a horizontal direction. The snap 13*a* detaches to the snap 14 of the base body 3

The present invention is composed as mentioned above.

Hereafter, it is explained how to use.

When the present invention is used, the movable storage member 2 according to the use purpose is chosen, and the base body 3 is equipped.

After removing the lower part of the movable belt 10 from fixation part 17 and passing to the base belt 9 for the equipment, it fixes to the fixation part 17 with the snap. Then, as shown in FIG. 6*a*, the movable belt 10 is supported by the base belt 9 at the upper fixation part 17 of the movable belt 10. For the movable belt 10 and base belt 9, preferably, the upper edges of the movable base 4 and base body 3 are provided in the position as the almost same height in the supported state.

When the movable storage member 2 is raised, the handle is grasped and raised upwards, but since the light and left parts of the base belt 9 are fixed to the base body 3, the base belt 9 plays the role of a guide.

Under the present circumstances, since the width of the base belt 9 which can be passed the movable belt 10 is wider than the belt width of the movable belt 10, it is possible to make move in the right-and-left direction with spaces as shown in FIG. 7. Therefore, it is easy to rise from the various postures according to the user's situation and return.

The supplementary explanation from a side situation is given about this operation with reference to FIG. 9.

Under the usual storage state in the bag, the base belt 9 supports the movable belt 10. Under the present circumstances, although the snap 14 of the base body 3 is separated preferably from the snap 13 of the movable storage member 2. The snap 14 and snap 13 are preferably engaged each other as shown in FIG. 9*a* when the storage implement 1 moves and changes to the bag and is put into the bag. Thereby, the movable storage member 2 is fixed to the base body 3 at the stable state, and it prevents to shake the movable storage member 2 by movement and bringing, and the portability improves.

In addition, when it is put into the bag, the snap is taken off.

When it is lifted up, there are the spaces at the right and left sides thereof, and the movable belt 10 has length and is formed of the material, which is produced the space a little, as shown in FIG. 9*b* so that the spaces which moves forward and backward are produced. Thereby it can be improved to the operation from various postures.

When the movable storage member 2 is lifted up and the stored object is taken out from the storage part, it is possible to take out at a lifted state by one hand. As shown in FIG. 9*c*, since another side of the both-sided adhesive 12 which is attached at the lower part of the movable belt 10 adheres one side of the both-sided adhesive 11 which is attached to the upper part of the base body 3, it is possible to fix the movable storage member 2 at a lifted state. Thereby the stored object can be taken out by one hand after it is lifted up by same hand.

For the present invention, as shown in FIG. 8, it is possible to take various effects such as improvement of capacity of the bag, take-out operation and maintaining the shape of the bag by putting into various bags including a tote bag 18 and performing the above-mentioned operation. As shown in FIGS. 8 and 10, the size of the storage implement is preferably the substantial same as the width of the bag. The it has preferably the height which is lifted to the position which can check the stored object in the storage part when it is lifted up as shown in FIG. 10. In addition, although the handle of the movable storage member 2 protrudes from the tote bag 18 in FIG. 18, it is needless to protrude and it may be positioned to operate easily.

Then, when the storage part of the bag is darkening up according to the usage position or environment, it can be easily to use because of the persistence phosphor.

It is not limit for using the persistence phosphor as means for visibility at night, in the dark and the like. The emission means including light-emitting diode or resemble structure as it is used may be used.

In addition, the stored object is stored in each storage part so that it can be protected to lose the shape, damage, break down and the like by putting the stored object on other stored object.

It is not limited to the above-mentioned case for the shape and arrangement of the storage part of the movable storage member 2 in the present invention. When the user can prepare the storage parts corresponding to necessary for going to hospital such as the insurance proof, consultation certificate, and medicine putting when it limits to the purpose of going to hospital for instance, it is very convenient. In addition, it is possible to combine various compositions corresponding to the purpose of use.

Various detaching fixation means and attachment means including the both-sided fastener, snap and the like are not limited to the above-mentioned case, and it may be used such means which achieves the similar effect of the conventional means.

Figure 11:
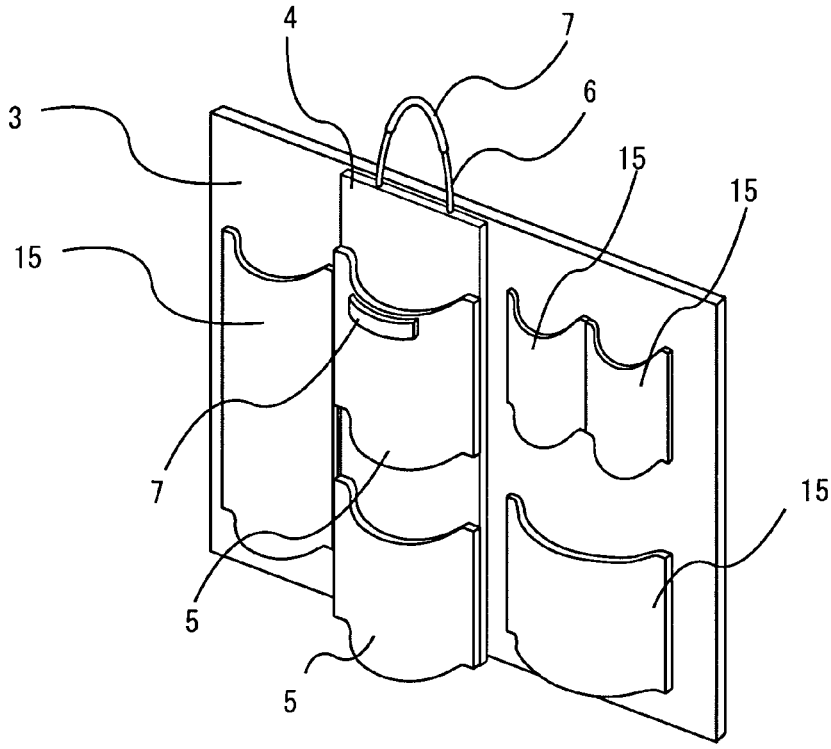
FIG. 11 is a perspective view of another example of the present invention.

In addition, it is not necessary to arrange the movable storage member at the front surface of the base body. It can be combined with the movable storage member 2 and fixed storage part 15 as shown in FIG. 11.

In addition, each mechanism with the movable storage member is attached not only one side but also both sides.

Figure 12:
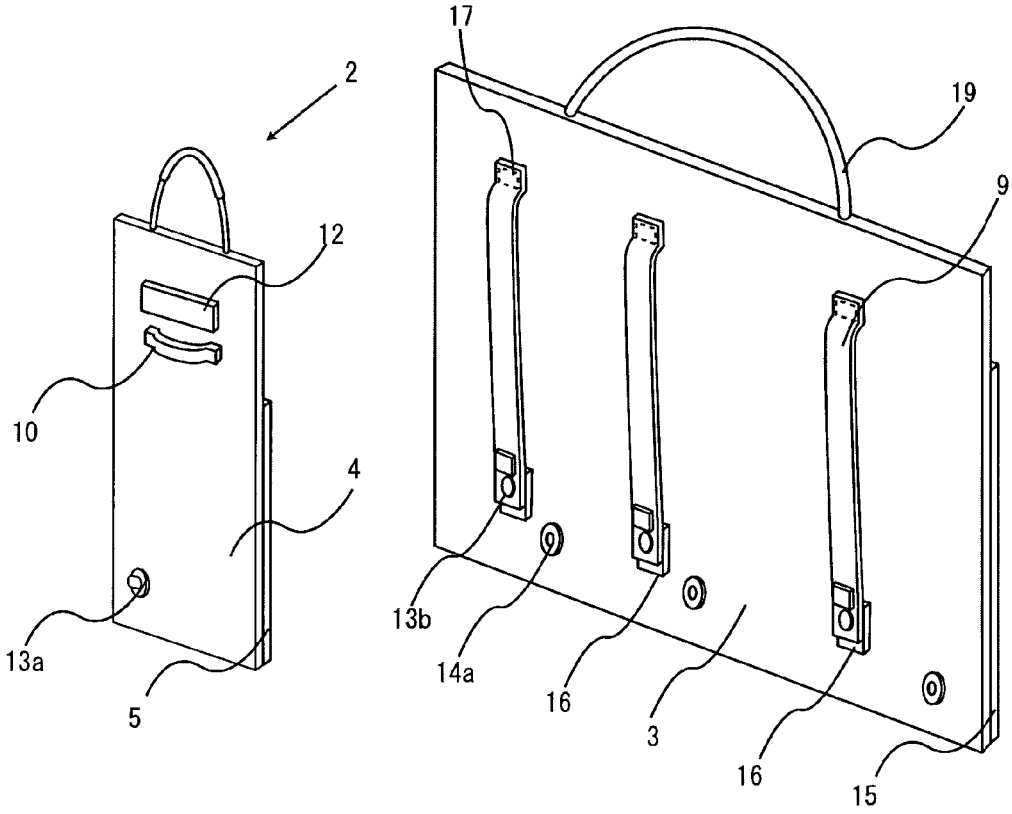
FIG. 12 is an exploded explanation view of further example of the present invention.

Furthermore, as shown in FIG. 12, when a handle 19 is attached to the base body 3, the user can use only base body 3, and it is easy to remove between the bags.

Figure 13:
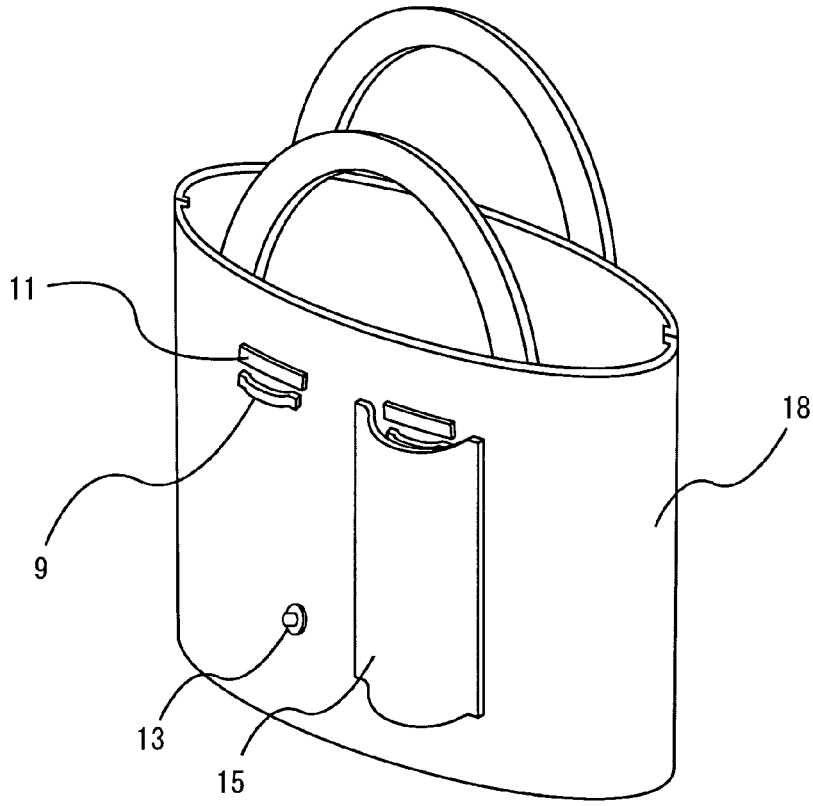
FIG. 13 is a perspective view of further example of the present invention.
Figure 14:
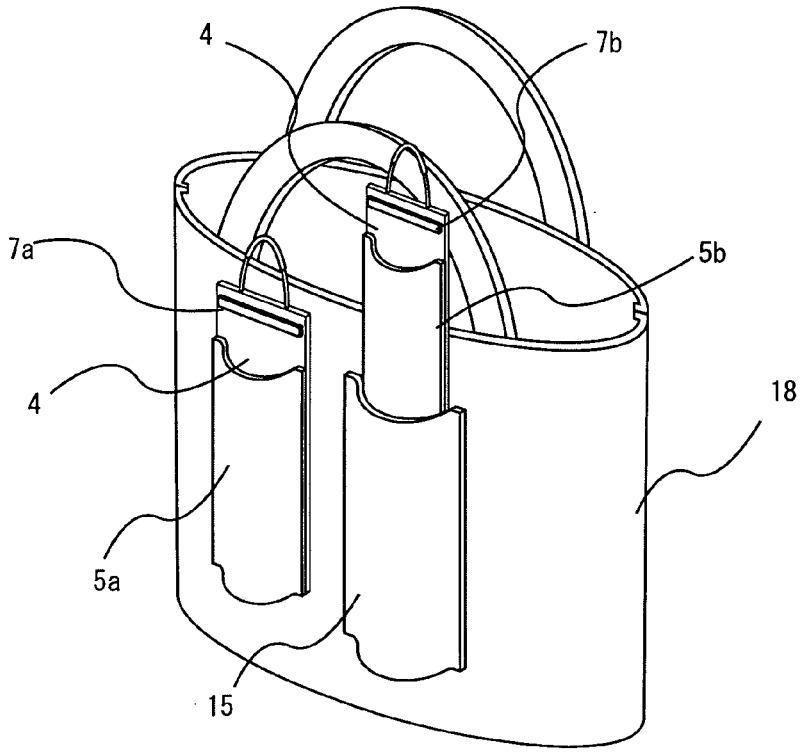
FIG. 14 is an explanation view of further example when in use of the present invention.

In this embodiment, it is explained that the storage implement is put in the bag, and it may be used the movable storage member in the bag which is illustrated in FIGS. 13 and 14.

FIG. 13 is a perspective view of further example of the present invention; and FIG. 14 is an explanation view of further example when in use of the present invention.

In this embodiment, as shown in FIG. 13, the movable storage member is attached to the surface of the tote bag 18. The base belt 9 is attached at the left side of the surface thereof, and one side of the both-sided fastener 11 is attached at the upper part of the base belt 9. In addition, the snap 13 is attached to the lower part of the base belt 9.

In addition, the same mechanism as mentioned above and the storage part 15 are attached to the right side thereof.

When the above-mentioned composition is added the movable storage member described at this embodiment, as shown in FIG. 14, it can be used for the bag itself. In addition, it can be attached inside the bag, and the base body 3 can be attached fixedly into the bag as a partition for the bag.

Figure 15:
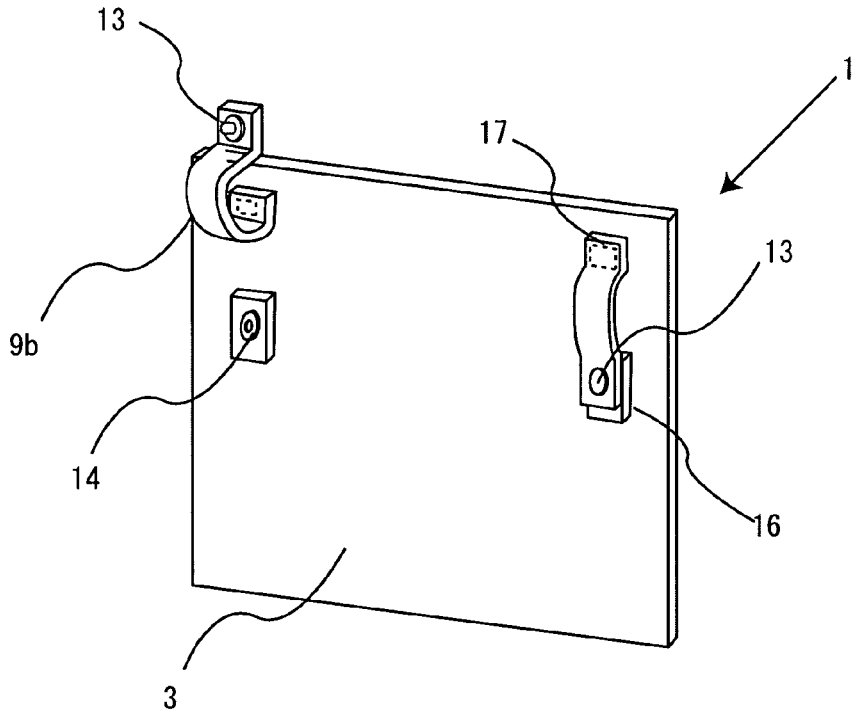
FIG. 15 is an explanation view showing a second embodiment of the present invention.
Figure 16:
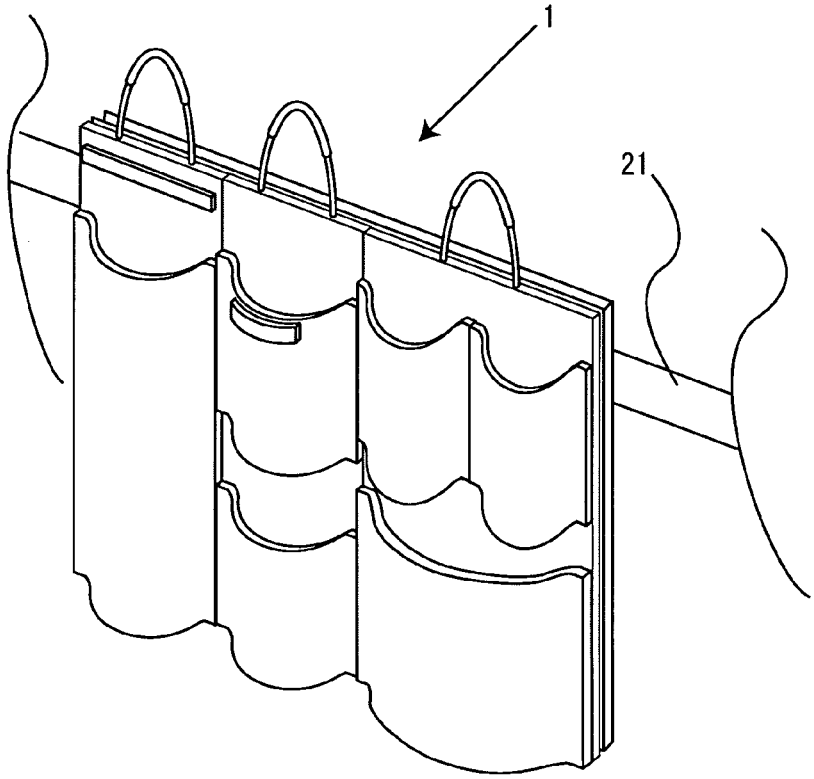
FIG. 16 is an explanation view when in use showing the second embodiment of the present invention.

An understanding of the second embodiment of the present invention may be best gained by reference FIGS. 15 and 16.

FIG. 15 is an explanation view showing a second embodiment of the present invention; and FIG. 16 is an explanation view when in use showing the second embodiment of the present invention.

In this embodiment, the movable storage member 2 that is described in each embodiment is provided at the surface of the base body 3, and it is fixed detachably to the frame as the fence. Therefore, it can be improved the convenience for the user of the bed and clinical nurse.

The base belt 9*b* is attached at the left and right sides of the back surface of the base body 3. An upper end part of the base belt 6 is attached to a fixation part 17, and the lower end thereof is attached the snap 13 to the direction of the base body. A fixation member is attached to the lower part of the base body, detaching to the base belt 9*b*, and the snap 14 is provided at a surface of the fixation member 16, detaching to the snap 13.

When it is used, the base belt 9*b* is wound around a fence frame 21 and fixed, and the storage implement 1 of the present invention is attached to the bed.

When it is attached, as shown in FIG. 16, since the handle of the movable storage member 2 protrudes at the upper part of the fence, the stored object can be taken out without hanging out of the fence.

In addition, goods and tools that are need in the nursing care are stored in the storage part so that it can avoid waste of time and labor hour since they are checked visually even though the nurse changes.

An understanding of the second embodiment of the present invention may be best gained by reference FIGS. 17 to 20.

Figure 17:
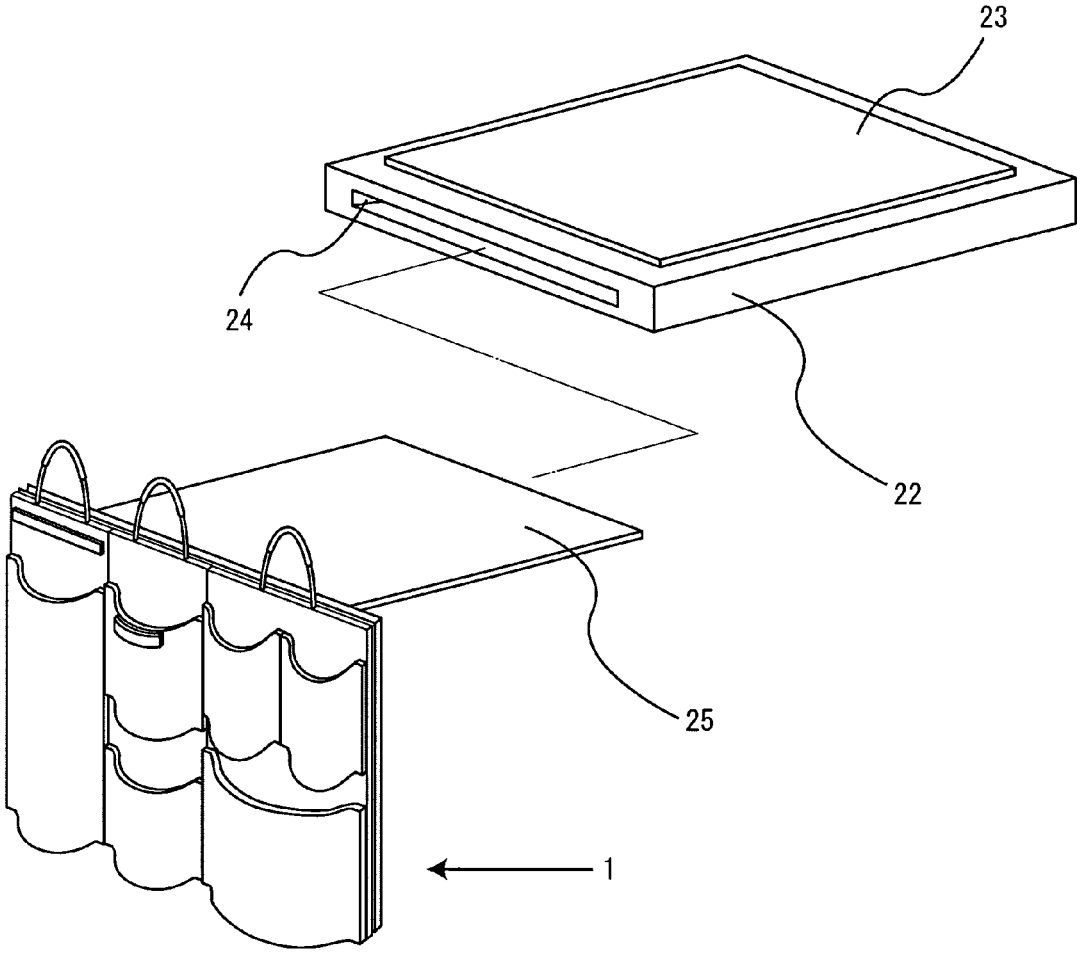
FIG. 17 is an exploded view showing a third embodiment of the present invention.
Figure 18:
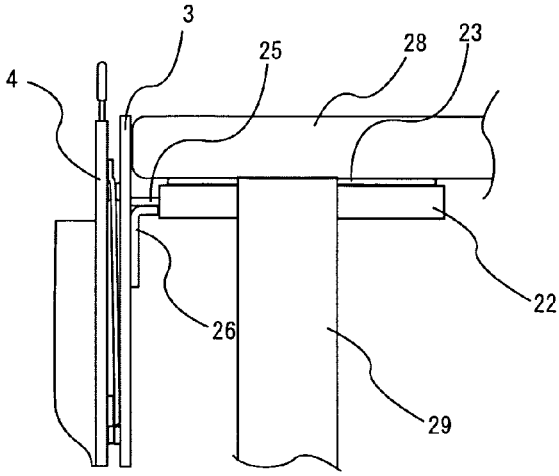
FIG. 18 is an explanation view when in use showing the third embodiment of the present invention.
Figure 19:
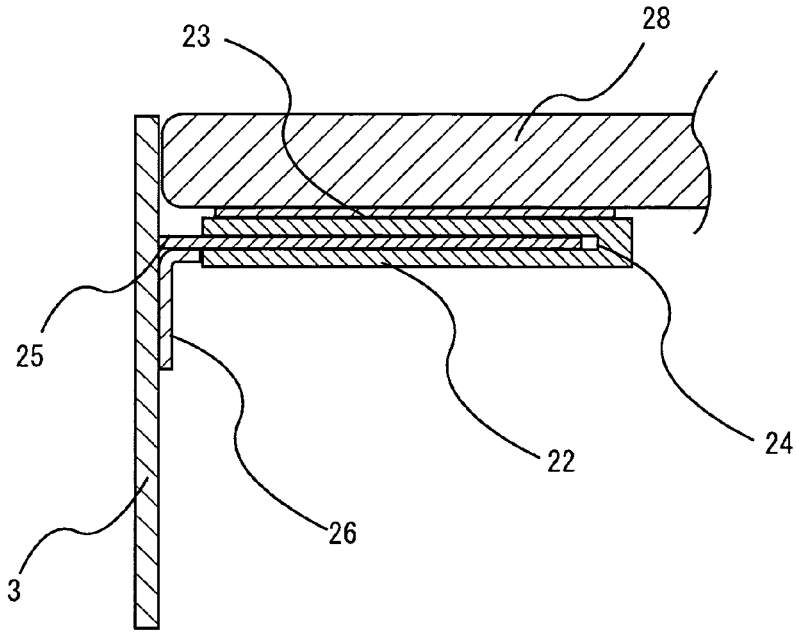
FIG. 19 is a cross sectional view when in use showing the third embodiment of the present invention.
Figure 20:
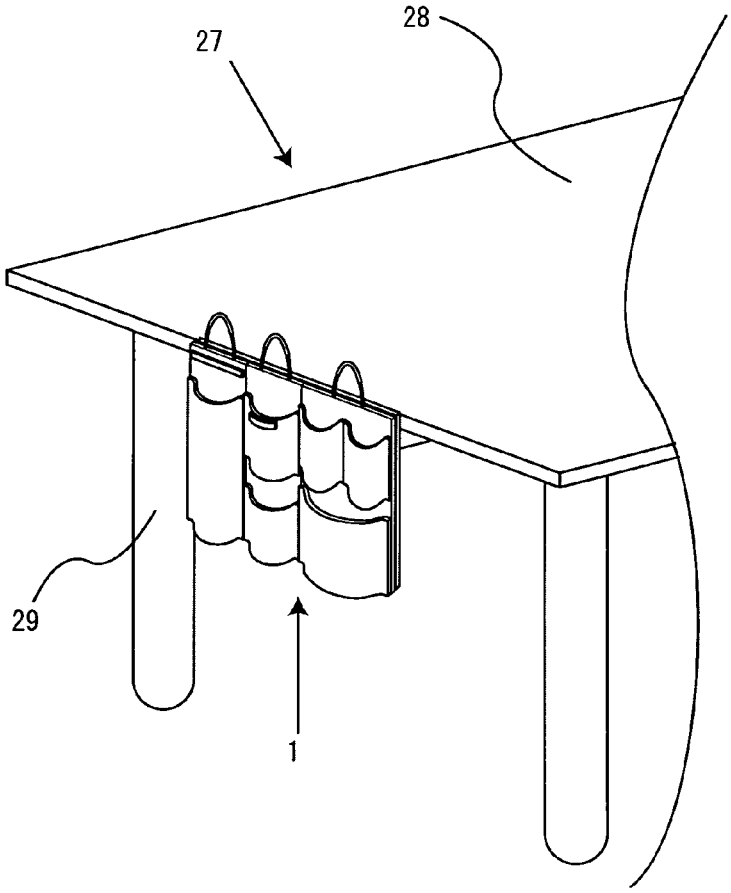
FIG. 20 is an explanation view when in use showing the third embodiment of the present invention.

FIG. 17 is an exploded view showing a third embodiment of the present invention; FIG. 18 is an explanation view when in use showing the third embodiment of the present invention; FIG. 19 is a cross sectional view when in use showing the third embodiment of the present invention; and FIG. 20 is an explanation view when in use showing the third embodiment of the present invention.

This embodiment of the present invention is an example of the storage implement that is arranged and used at the sides of table, desk and the like.

The storage implement of the present invention is comprised of a storage implement body and a fixation member that fixes the storage implement body.

The fixation member is defined by a case body 22 with the predetermined thickness, forming a storage part 24 capable of inserting the plate body from the side. A two-sided tape to fix to the backside of the top plate of the table or desk is attached on the case body 22.

The storage implement has such mechanism that the movable storage member 2 that is described in each embodiment is provided at the surface of the base body 3.

A detachable mechanism to fix detachably to the case body 22 is attached to the back surface of the base body 3.

The detachable mechanism is defined by an insertion piece 25, forming in the shape of almost same size of the case storage part 24 and inserting therein. A connection body 26, which is formed in the shape of a flexible sheet, is used as a fixation to the base body 3, and the lower half of the connection body 26 is adhered to the base body and the upper half thereof is adhered to the lower surface of the insertion piece 25.

The present invention is composed as mentioned above.

When it is used, it is fixed by the two-sided tape 23 to a portion adjacent the side edge of the backside of the top plate of the table or desk so as to direct an opening of the case storage part 24 to the side edge.

When not in use, the insertion piece 25 is held. When in use, the insertion piece 25 is inserted in the case storage part 24 as shown in FIG. 18. When it is inserted, as shown in FIG. 19, the side face of the top plate contacts to the upper part of the base body 3, and the base body is set to plumb by empty weight and supporting by a top plate 28.

As shown in FIGS. 18 to 20, the handle of the movable storage member 2 is set to expose the upper part of the top plate or near the top plate as the attachment position of the connection body 26 to the base body 3.

An understanding of the second embodiment of the present invention may be best gained by reference FIGS. 21 to 25.

Figure 21:
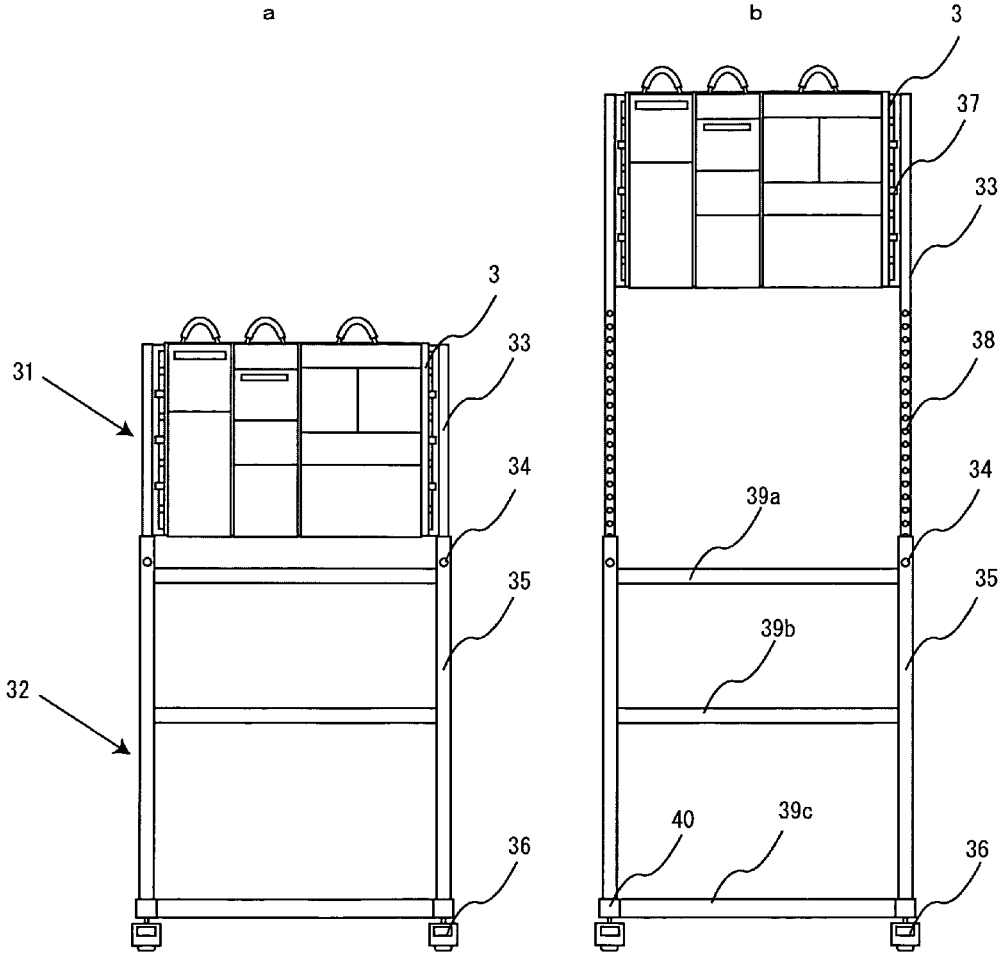
FIG. 21 is an explanation view when in use showing a fourth embodiment of the present invention.
Figure 22:
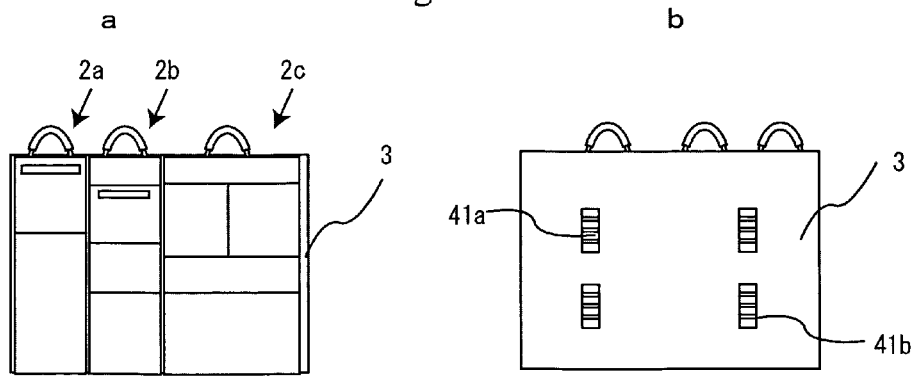
FIG. 22 is an explanation view showing the fourth embodiment of the present invention.
Figure 23:
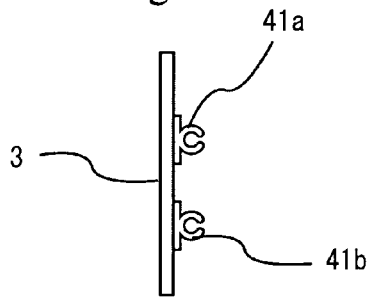
FIG. 23 is an explanation view of a mechanism showing the fourth embodiment of the present invention.
Figure 24:
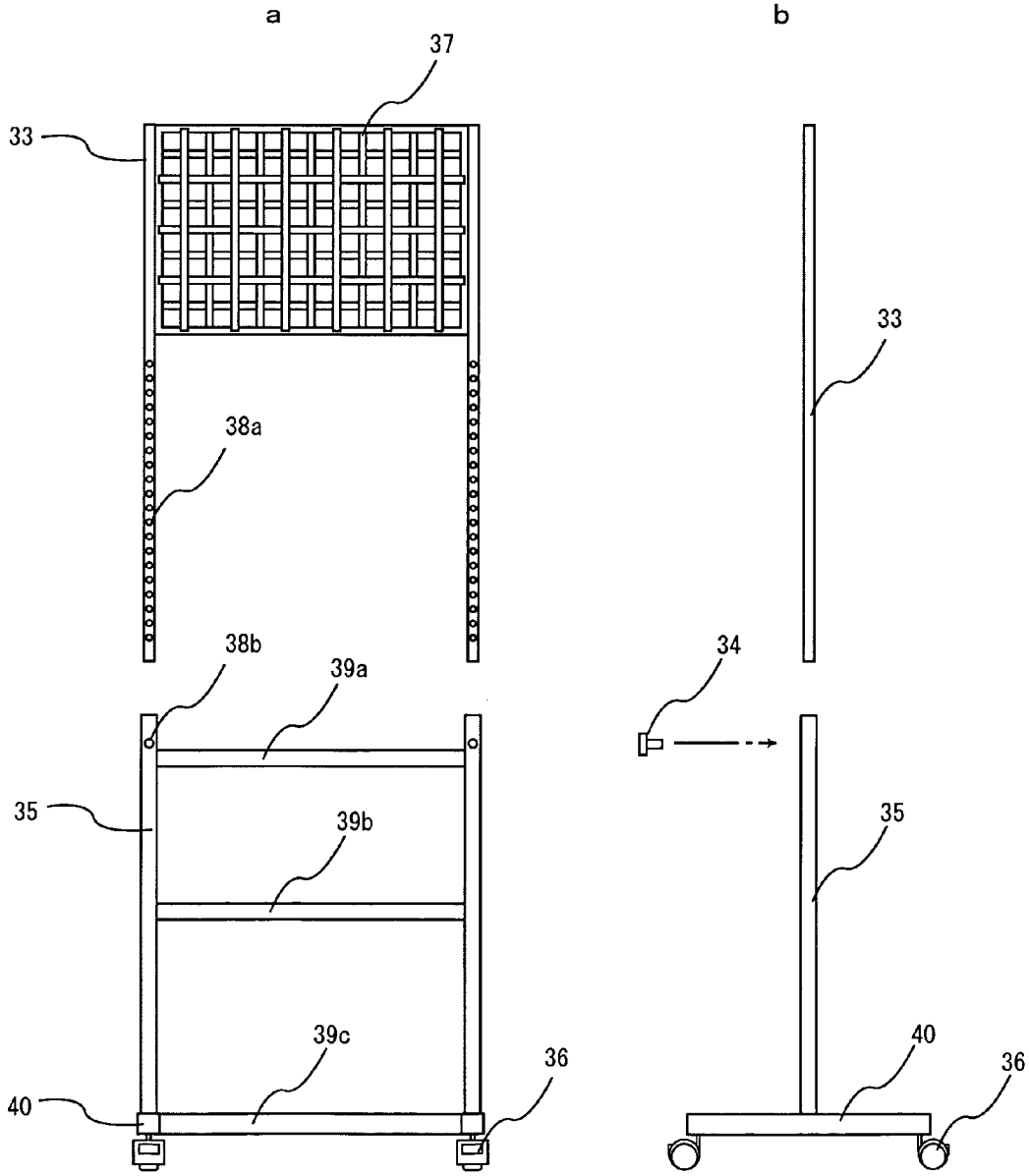
FIG. 24 is an exploded explanation view showing the fourth embodiment of the present invention.
Figure 25:
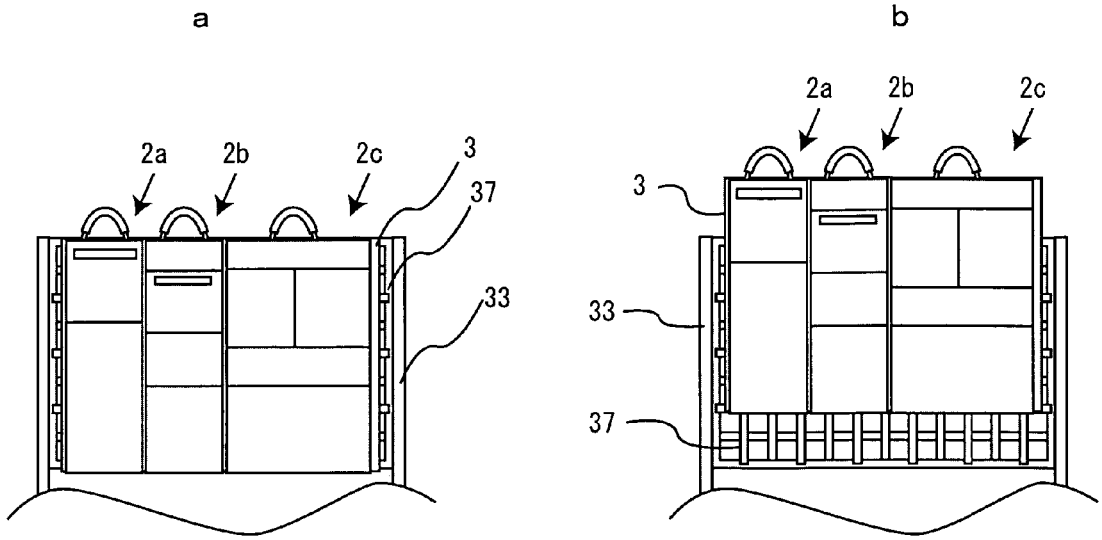
FIG. 25 is an explanation view when in use showing the fourth embodiment of the present invention.

FIG. 21 is an explanation view when in use showing a fourth embodiment of the present invention; FIG. 22 is an explanation view showing the fourth embodiment of the present invention; FIG. 23 is an explanation view of a mechanism showing the fourth embodiment of the present invention; FIG. 24 is an exploded explanation view showing the fourth embodiment of the present invention; and FIG. 25 is an explanation view when in use showing the fourth embodiment of the present invention.

The storage implement of this embodiment is comprised of a support member 32 for standing; a movable member 31 which moves slidably upward and downward to the support member 32; a stopper 34 which fixes the movable member 31 to the support member 32 at any height; and the storage implement 1 which is attached to the movable member 31.

As shown in FIGS. 21 and 24, the support member 32 has support poles 35, which are formed in the shape of a pipe respectively, which are arranged at left and right side thereof, and a horizontal frame 39 is attached between the support poles. An upper horizontal frame 39*a*, middle horizontal frame 39*b* and lower horizontal frame 39*c* are provided for eliminating distortion in the figure.

As shown in FIG. 24*b*, a leg frame 40 is attached at the lower end of the right and left support poles 35, directing to the forward and backward directions, and wheels 36 for moving are attached to the bottom surface of the edges of the front and back sides of the leg frame 40.

In addition, adjustment holes 38*b* penetrated in the direction of order are formed in the upper part of the right and left support pole 35 respectively.

For the movable member 31, the upper part of the slide pole 33 is fixed to the right and left of detachable bases 37 respectively. The detachable base 37 fixes detachably the storage implement 1, capable of adjusting the position, and it is formed in the shape of a network in this embodiment. Moreover, the slide pole 33 is the form which moves up and down inside of the support pole, and it is arranged at right and left sides according to the position of the support pole. The adjustment hole 38*a* which comes through forward and backward at a constant interval is formed in the lower part of each slide pole 33.

The stopper 34 is composed of an insertion member which is formed in the shape corresponding to the diameter of each adjustment hole 38 formed in the support pole 35 and slide pole 33, having the length which reaches the back part; and a head part formed at one end part of the insertion member.

The storage implement 1 is comprised of the base body 3; the movable storage member 2; detachable members which are fixed detachably and adjusts the position to the movable member 31, attaching to the base body 3 vertically and horizontally.

As shown in FIG. 23, the detachable member 41 is composed of the base fixed to base body and the clip part on the surface of the base, engaging to the upper part of the net of the detachable base 37.

The other composition of the storage implement consists of various compositions that are mentioned above.

The present invention is composed as mentioned above.

Hereafter, it is explained how to use.

When the user uses the storage implement of the present invention, it moves to the side of the bed or beside the table using the caster, and it is fixed by the stopper.

Next, the adjustment holes of the support pole and movable pole are fitted the position adjacent the height which is suitable for use after the stopper 34 is removed, and the stopper is set in the hole and the position is fixed.

The storage implement 1 is fixed to the detachable base 37 by the detachable member 41 provided at the back surface of the base body. Then, the upper end portion of the base body is set the approximate same height of the upper end portion of the detachable base 37 or is higher than the upper end portion of the detachable base 37. According to need, it can be attached by the right and left lower parts of the detachable member only.

The method for using is the same as each embodiment of the present invention. In this embodiment, it can be used in the place in which there is no object which is fixed the storage implement.

Figure 26:
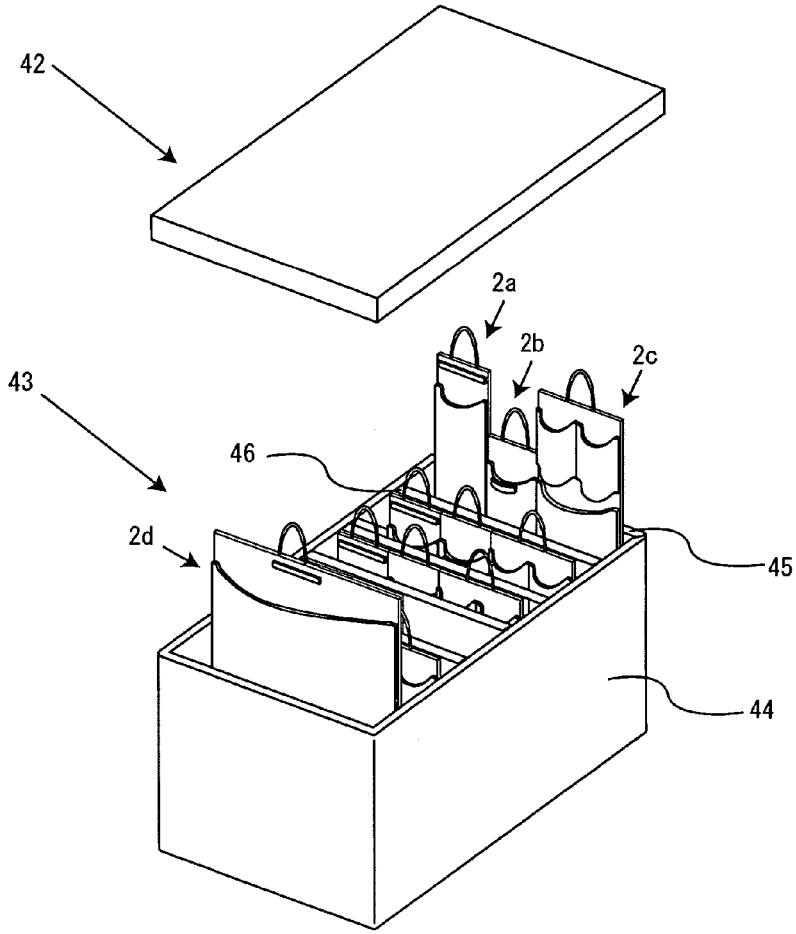
FIG. 26 is an exploded explanation view when in use showing a fifth embodiment of the present invention.

An understanding of the second embodiment of the present invention may be best gained by reference FIG. 26.

FIG. 26 is an exploded explanation view when in use showing a fifth embodiment of the present invention;

The present invention of this embodiment is comprised of a storage body 43 and a cover 42.

The storage body 43 is composed of a case body 44 which is formed in the shape of a box, having an opening at an upper surface thereof; a plurality of partitions 46 which are attached in parallel to the case body 44; the movable storage member 2; and means for connecting, as a belt, attaching movably the movable storage member 2 against a back plate 45 and any partition 46.

For the movable storage member 2 and connection means 2, the composition and condition which are set for the base body and movable storage member in each embodiment are leveraged.

The cover 42 is used for the storage body 43, and it covers the upper part in FIG. 26. However, the shape of the cover is not limited, and it can use the cover having a function which achieves the purpose of the present invention, that is, it connects with the cover and storage body and opens and closes by fastener.

The present invention is composed as mentioned above.

Hereafter, the usage is explained.

When the storage implement of the present invention is used, the movable storage member 2 is attached by the base belt provided at the partition 46 or back plate 45 and movable belt in the storage space which is produced by the case body 44 and partition 46.

Thereby, for the stored object which can be used the storage space by itself, the stored object is stored vertically. For the stored objects which need the segmentation in the storage space, the movable storage member is attached which can be moved for the purpose, and the stored object corresponding to the storage part is stored.

The stored object which is stored in the storage part can be got out when the handle of the movable storage member is got up.

The stored object stored in the storage space by itself is got out directly.

Moreover, when the stored object is put therein without any period, the cover 42 is used, and it is put and stored any place.

Figure 27:
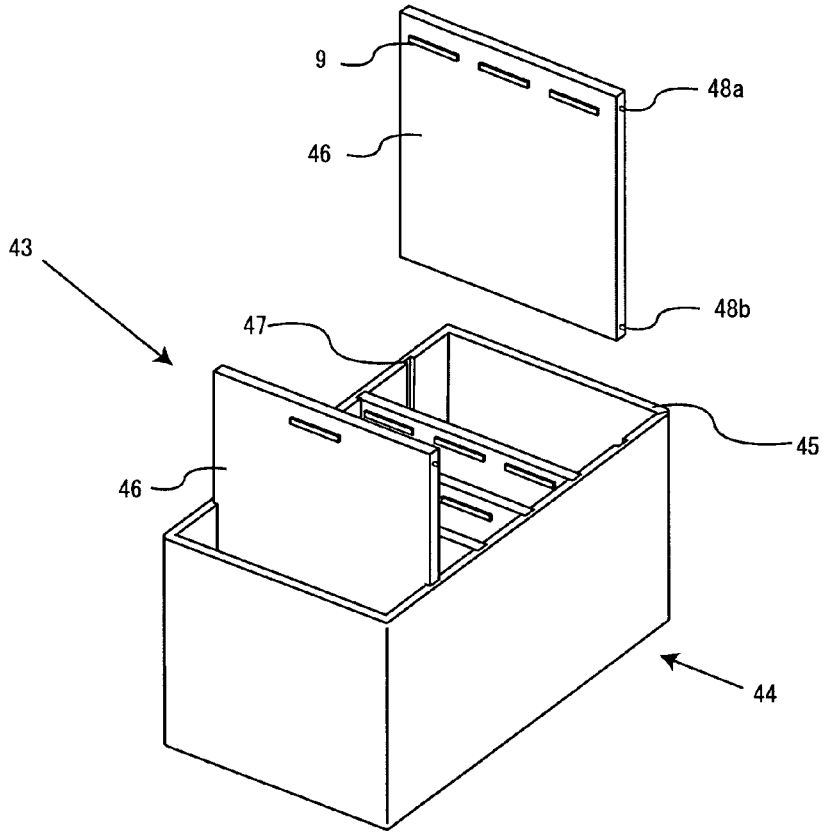
FIG. 27 is an exploded explanation view when in use showing a sixth embodiment of the present invention.
Figure 28:
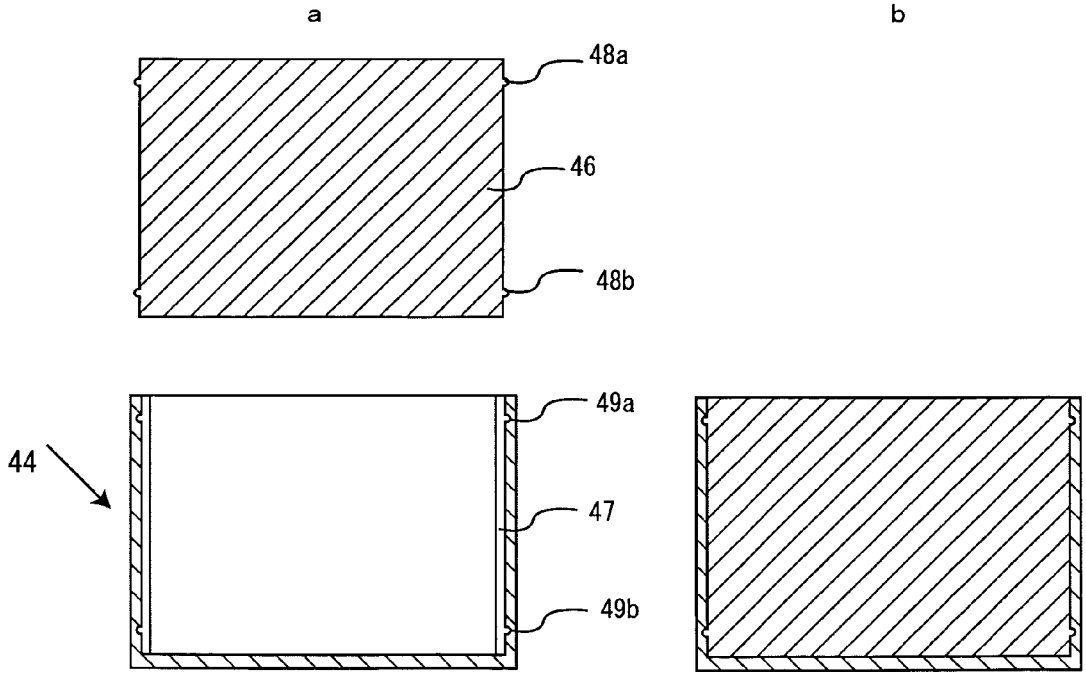
FIG. 28 is a cross sectional view showing the sixth embodiment of the present invention.

An understanding of the second embodiment of the present invention may be best gained by reference FIGS. 27 and 28.

FIG. 27 is an exploded explanation view when in use showing a sixth embodiment of the present invention; and FIG. 28 is a cross sectional view showing the sixth embodiment of the present invention.

In this embodiment, the partition 46, which is disclosed in the fifth embodiment, can detach from the case body 44.

The guide groove 47 is formed in the position which faces the inner wall of right and left sides of the case body 44 to the vertical direction.

The width and thickness of the base body 3 used as the partition has the size that is not shaky as much as possible in accordance with the guide groove 47. Moreover, the projection 48 is formed in the vertical position of the right-and-left side respectively. FIG. 27 illustrates the situation that the movable storage member is removed, and other basic composition is defined by the attachment structure which can use the composition described in each embodiment.

As shown in FIG. 28*a*, an engaging part 49 with concave is formed in each guide groove, corresponding to the position and size corresponding to the projection 48.

The present invention is composed as mentioned above.

When it is used, the base body 3 is inserted in the guide groove 47 of the case body 44 from above at the intervals according to the use purpose. Then, as shown in FIG. 28*b*, the projection 48 of the base body 3 engages with the engaging part 49 and is stable fixed. In addition, although not illustrated in the figure, it is used to attach the movable storage member 2 according to the usage purpose. Then, it can be used as partition only without the movable storage member according to the usage purpose.

In addition, although the base bodies 3 use the guide groove 47 in the figure, a part of the base body may be attached to the case body 44 integrally.

Figure 29:
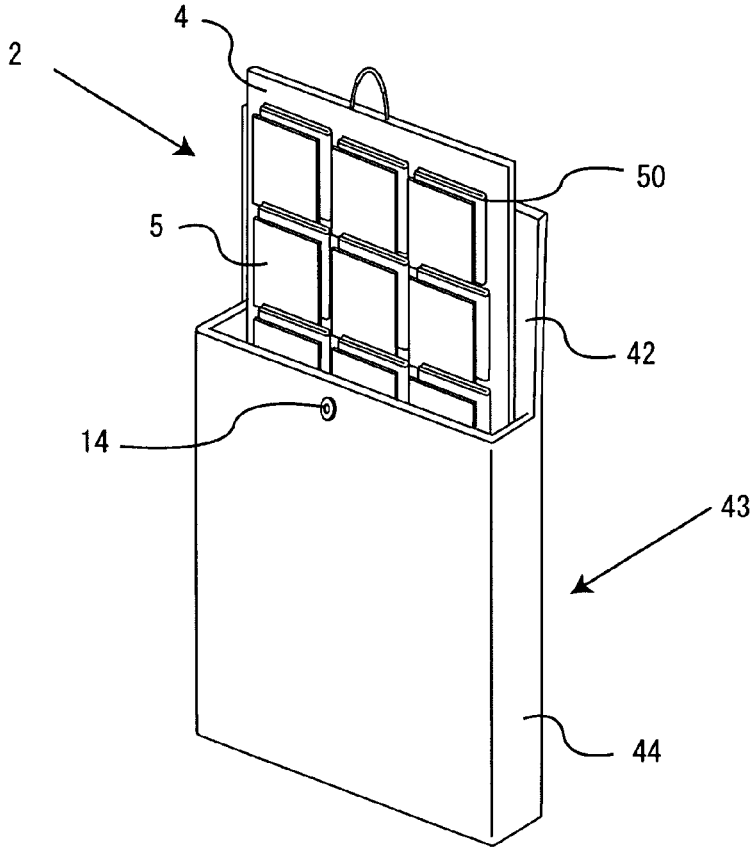
FIG. 29 is an explanation view when in use showing a seventh embodiment of the present invention.
Figure 30:
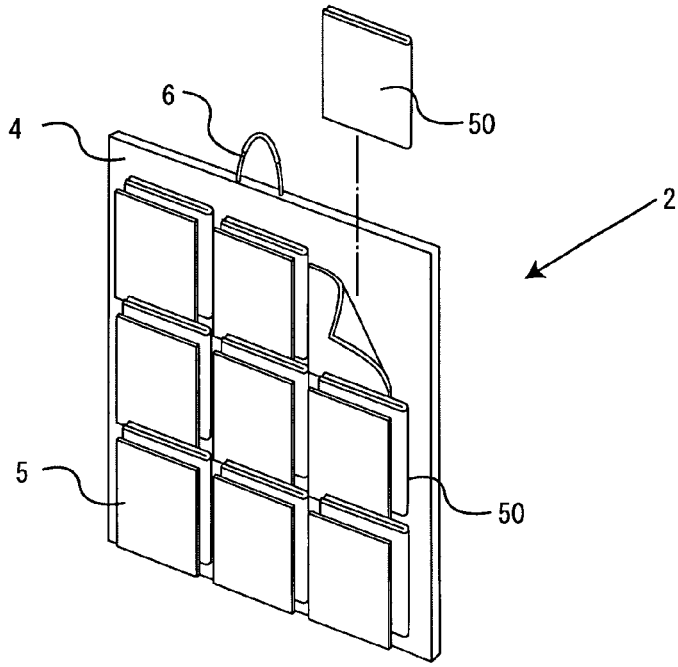
FIG. 30 is an explanation view in main part showing the seventh embodiment of the present invention.

An understanding of the second embodiment of the present invention may be best gained by reference FIGS. 29 and 30.

FIG. 29 is an explanation view when in use showing a seventh embodiment of the present invention; and FIG. 30 is an explanation view in main part showing the seventh embodiment of the present invention.

The present invention attaches the base belt to the inner wall in a back plate 45 of the case body 44 with the cover 42, and the attachment structure that can be used, showing in each above-mentioned embodiment. The cover 42 can detach so as to cover the upper opening part by the snap in a state that the movable storage member 2 is stored.

The storage part 5 of the present invention is fixed the bottom and left edges of a face member by adhesion or sutura to the movable base 4, which is not formed in the shape of a pocket. Then, the face member has flexibility, bending at the range to store the stored object.

Moreover, any fixed means such as a double-sided tape and magnet sheet is provided at the back of the case body 44.

The present invention is composed as mentioned above.

When using this, it fixes to any position of a closet, wall and the like by the fixed means.

Thin things such as a handkerchief and tissue are stored in the storage part 5. Usually, the whole movable storage member 2 is put in the case body 44 and is fixed by the snap of the cover and the snap of the case body so that the cover may close the opening. Thereby, the stored object can be protected from dust The stored object is taken out by lifting to use the handle 6.

In addition, the shape of the cover and case and the number of the movable storage member 2 are not limited.

As set forth above, the advantages of the invention are as follows:

A base body (3) is stored in a bag (8).

Movable storage members (2*a*, 2*b*, 2*c*) are attached to the said base body (3) with base belts (9) and a movable belt (10).

Storage things stored and carried in the bag (8), such as cards or portable telephones, are stored by said movable storage members (2*a*, 2*b*, 2*c*).

For this reason, only required said movable storage members (2*a*, 2*b*, 2*c*) can be pulled out, without pulling out the said base body (3) from the bag (8), when taking out the storage thing stored in the bag (8).

Therefore, since a required storage thing is movable to the opening of the bag (8) by turning the slide movement of the storage member up, a storage thing can be easily taken out from the inside of a bag (8).

Moreover, when storing the taken-out storage thing, after storing a storage thing in movable storage members (2*a*, 2*b*, 2*c*), said storage thing can be stored in a bag (8) by pushing the said movable storage members (2*a*, 2*b*, 2*c*) into the bag (8) at the state which carried out arrangement order.

What is claimed is:

1. A storage implement comprising:

a bag;

a base body (3);

a plurality of base belts (9) provided on one side or both sides of said base body (3) vertically or horizontally;

a plurality of movable storage members (2*a*,2*b*,2*c*) capable of controlling movement with each of said plurality of movable storage members is attached to each of said plurality of base belts (9) by a movable belt (10);

said movable belt (10) which is attached to each of said plurality of base belts (9) provided on a back side of each of said movable storage members (2*a*,2*b*,2*c*) horizontally or vertically.

2. The storage implement according to claim 1, further including a handle mechanism for carrying movably which is provided on said base body.

3. The storage implement according to claim 1, further including a temporary fixing means provided on each of said movable storage members which is fixed temporarily that each of said movable storage members is hung or pulled up at least.

4. The storage implement according to claim 1, further including means for detaching, exchanging said base body and said movable storage members detachably.

5. The storage implement according to claim 1, wherein each of said movable storage members is produced as a suitable size to store goods for a hospital visitor including an insurance card and a medical examination card.

* * * * *